United States Patent [19]

Landa et al.

[11] Patent Number: 4,921,241

[45] Date of Patent: May 1, 1990

[54] COPY SHEET REGISTRATION ASSEMBLY FOR ELECTROPHOTOGRAPHIC COPIER

[76] Inventors: Benzion Landa, 10045 - 118th Street, Apt. 206, Edmonton, Alberta, Canada, T5K 1Y1; Oded Sagiv, 27 Hagefen Street, Ramat-Gan; Nathan A. Levy, 31 Keren Hayesod Street, Ra'anana, both of Israel

[21] Appl. No.: 179,605

[22] Filed: Apr. 11, 1988

Related U.S. Application Data

[62] Division of Ser. No. 919,871, Oct. 16, 1986, abandoned, which is a division of Ser. No. 628,611, Jul. 6, 1984, Pat. No. 4,620,699.

[51] Int. Cl.[5] ..... B65H 9/06

[52] U.S. Cl. ..... 271/245

[58] Field of Search ..... 271/245, 246

[56] References Cited

U.S. PATENT DOCUMENTS

| | | | |
|---|---|---|---|
| 4,019,732 | 4/1977 | Hunt | 271/245 |
| 4,019,733 | 4/1977 | Montalto | 271/245 |
| 4,223,886 | 9/1980 | Vogt | 271/246 |
| 4,473,222 | 9/1984 | Simmons | 271/245 |

*Primary Examiner*—Richard A. Schacher

[57] ABSTRACT

Apparatus for registering a copy sheet prior to feeding the sheet to the image-transfer station of an electrophotographic copier. Opposing pairs of relatively rigid feed rollers are arranged on shafts in alternating relationship with opposing pairs of relatively compliant feed rollers, which are of somewhat larger diameter than the rigid rollers so as to form nips of appreciably greater extent in the direction of feed. Registration gates mounted for rotation on one of the roller shafts through slipping couplings are selectively restrained against rotation with the roller shaft either in a non-blocking position out of the feed path or in a blocking position within the nip area of the compliant rollers but upstream of the nip area of the rigid rollers. A crimper comprising an anvil rotating with one of the registration gates and a hammer supported by the anvil for pivotal movement into a recess in the anvil deforms a leading edge portion of the copy sheet as it is advanced from the registration rollers to facilitate separation of the sheet from the photoconductor after image transfer by a pickoff element spaced from the photoconductor.

6 Claims, 6 Drawing Sheets

FEED ROLL DRIVE
SEPARATOR ROLL DRIVE

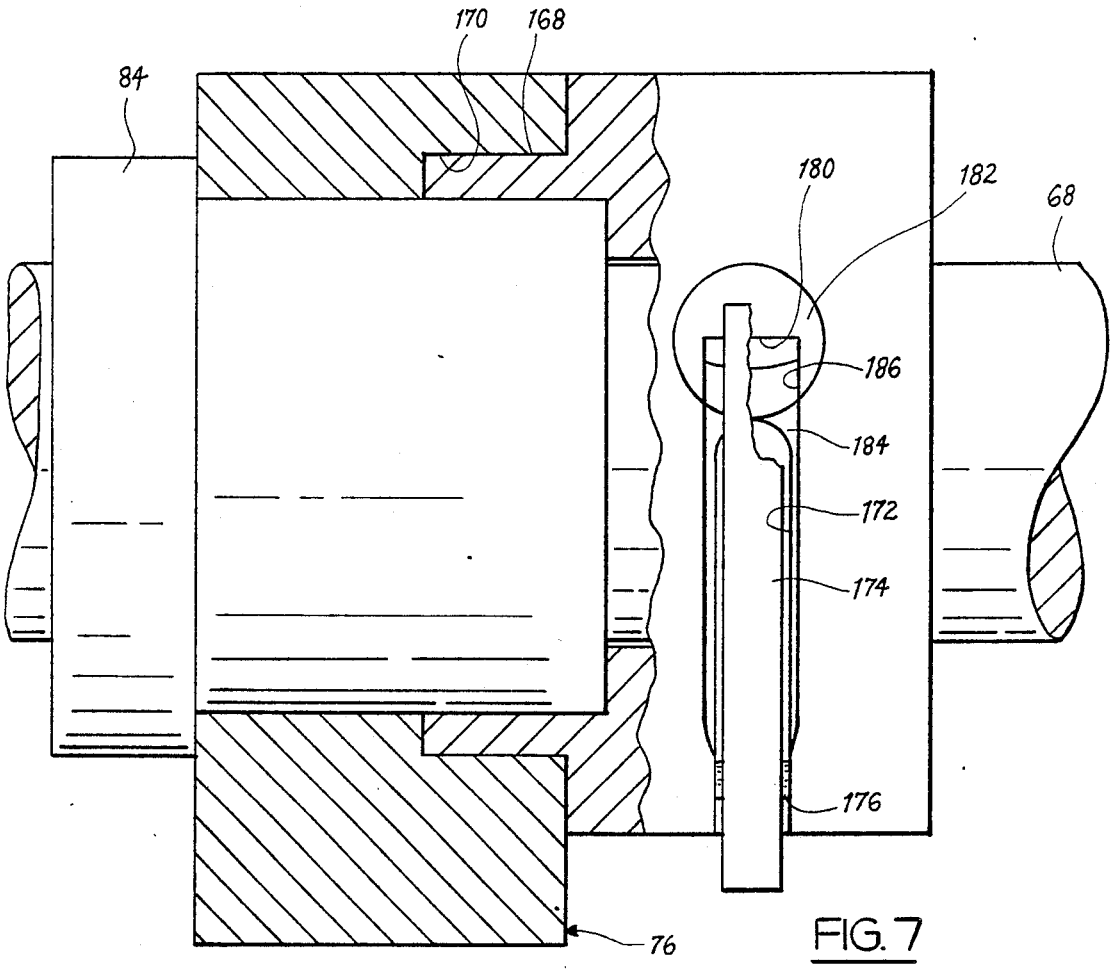
FIG. 7
FIG. 11
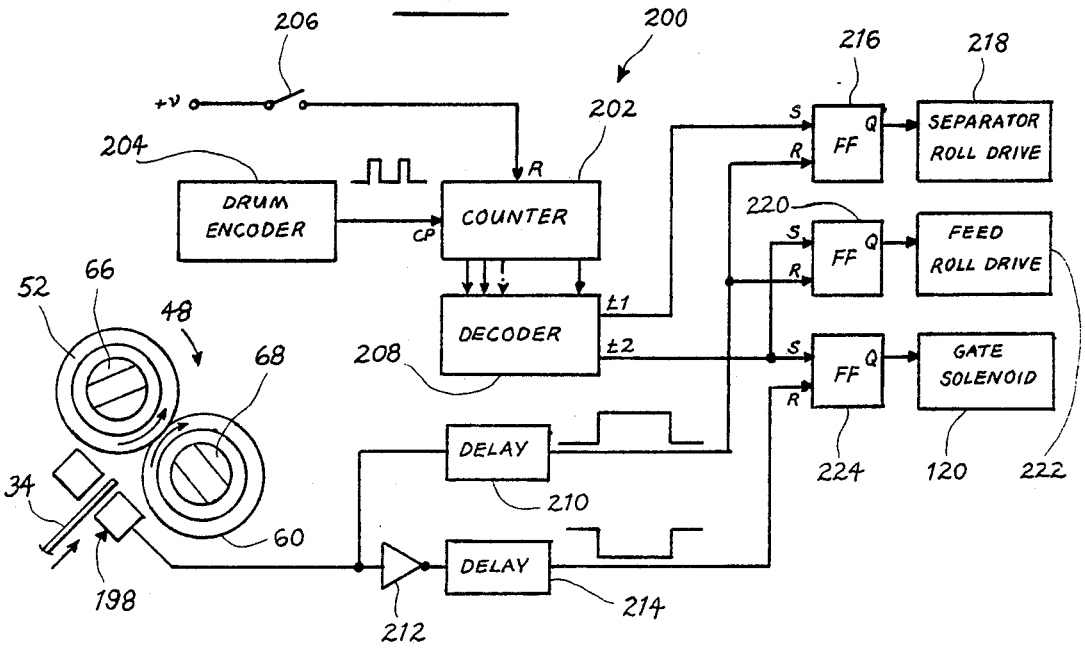

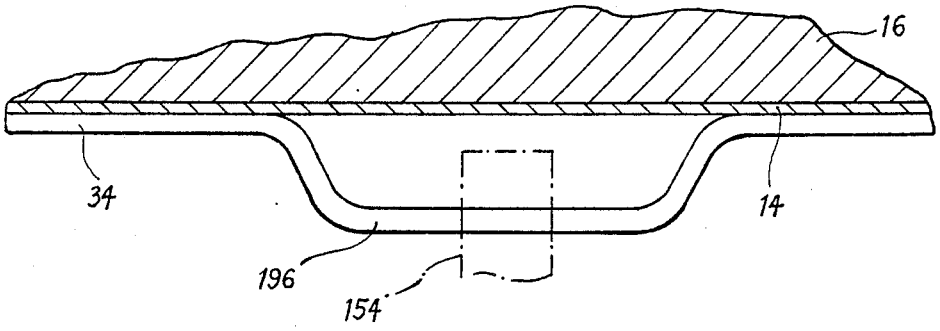
FIG. 9
FIG. 8
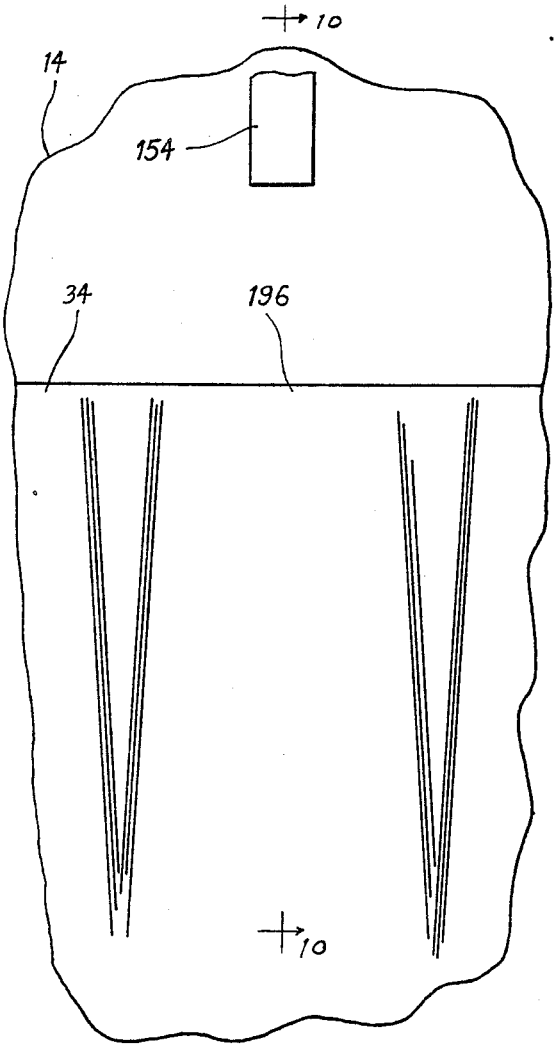
FIG. 10
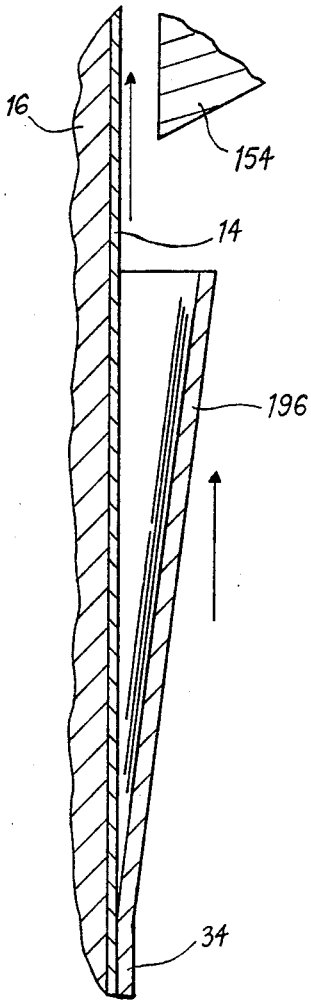

COPY SHEET REGISTRATION ASSEMBLY FOR ELECTROPHOTOGRAPHIC COPIER

This application is a division of application Ser. No. 06/919,871 filed on Oct. 16, 1986, now abandoned which was a division of application Ser. No. 06/628,611 filed on July 6, 1984, now U.S. Pat. No. 4,620,699.

FIELD OF THE INVENTION

Our invention relates to an assembly for registering a sheet prior to feeding it to a subsequent location such as the image-transfer station of an electrophotographic copier. Our invention relates further to apparatus for deforming the leading edge of such a sheet to facilitate its separation from a member such as a photoconductor from which the sheet receives a developed image.

BACKGROUND OF THE INVENTION

Electrophotographic copiers of the image-transfer type, or plain-paper copiers as they are, generally called, are well known in the art In copiers of this type, an electrostatic latent image is first formed on a photoconductor by uniformly charging the photoconductor and then exposing the photoconductor to a light image of an original document to discharge portions of the photoconductor in a pattern corresponding to the graphic matter on the document The photoconductor bearing the latent image is then subjected to the action of a developer, or toner, to form a developed toner image, which is transferred to a carrier sheet such as paper. Generally, in electrophotographic copiers employing the process described above, the photoconductor comprises an endless member, usually in the form of a drum, that is continuously moved at a predetermined velocity throughout the entire copy cycle. To transfer the developed toner image from the photoconductor to the carrier sheet, the sheet is brought into close proximity or actual contact with the photoconductor, while moving at the same velocity, in a transfer station.

In order to ensure that the leading edge of the carrier sheet is advanced to the transfer station in synchronism with the arrival of the leading edge of the developed toner image, the carrier sheet is first fed to a registration station, where it is momentarily held. As the leading edge of of the developed image approaches the transfer station, feed members are actuated to advance the sheet from the registration station. By prefeeding the carrier sheet to the registration station in this manner, one avoids the loss of synchronism that may occur if the sheet slips relative to a feed member as it is initially fed from a stack.

Generally, in registration stations of the prior art, the leading edge of the carrier sheet is advanced to a registration position defined by a pair of opposing friction feed rollers, which remain stationary while the sheet is being held. One disadvantage of registration systems of this type is that the registration position depends on the sheet thickness, as well as the longitudinal extent of the registration nip. The longitudinal extent of the registration nip depends in turn on such factors as the compliance of the registration rollers and the normal nip force. Since these factors cannot be precisely controlled, the exact registration position of the carrier sheet remains uncertain.

Another problem encountered with registration systems of this type involves the acceleration of the carrier sheet to the photoconductor velocity when the registration rollers are actuated. Even a momentary slippage between the carrier sheet and the registration rollers will result in loss of synchronism between the leading edge of the sheet and that of the developed toner image. Further, if unequal slippage occurs across the width of the sheet, skewing will result. It is known in the art to advance a carrier sheet a sufficient distance from the stack so as to create a buckle in the registration nip, thereby urging the leading edge into the nip, so as to minimize slippage upon actuation of the registration rollers. However, even this expedient does not entirely eliminate the possibilities for slippage. Slippage is particularly likely to occur if the leading edge of the sheet is registered against a gate which is intermittently moved into the sheet path slightly upstream of the rollers.

Still another problem, inherent in image-transfer electrophotographic copiers generally, is that of separating the carrier sheet from the photoconductor surface following transfer of the developed image. A common expedient is to use a pickoff blade which intercepts the leading edge of the carrier sheet as it emerges from the transfer station to separate the adjacent edge portion of the sheet from the photoconductor. However, if such a blade is allowed to contact the photoconductor drum it will damage the drum surface over time. Further, the blade will become contaminated with remnant developer from the drum surface, producing streaks on the passing surface of the copy sheet.

It is known in the art, as shown in Hukuda et al 4,408,861, to deform a portion of the leading edge of the carrier sheet at the registration station so that the deformed edge portion remains spaced from the photoconductor at the transfer station. In such a system, the pickoff blade may be spaced slightly from the drum surface so as to avoid abrasion of the drum surface or contamination of the contacting blade portion. However, in the apparatus disclosed in the patent, all or a substantial portion of the leading edge of the sheet is bent away from the photoconductor, producing a corresponding void in the leading edge portion of the transferred image. Further, in the disclosed apparatus, in which a rotating deforming member urges the leading edge of the sheet against a resilient roller, the extent of sheet deformation remains uncertain.

OBJECTS OF THE INVENTION

One object of our invention is to provide a registration system that ensures accurate registration of a sheet prior to its feeding to a subsequent location, such as the transfer station of an electrophotographic copier.

Another object of our invention is to provide a registration system that advances a sheet to a subsequent station without slipping or skewing.

Still another object of our invention is to provide a registration system for an electrophotographic copier that allows the use of a pickoff member that is spaced from the photoconductor.

A further object of our invention is to provide a registration system that does not produce large image voids along the leading edge of the sheet.

A still further object of our invention is to provide a registration system that is simple and inexpensive.

Other and further objects of our invention will be apparent from the following description.

SUMMARY OF THE INVENTION

In one aspect, our invention contemplates apparatus for registering a copy sheet prior to feeding the sheet to the image-transfer station of an electrophotographic copier in which opposing pairs of relatively rigid feed rollers are arranged on shafts in alternating relationship with opposing pairs of relatively compliant feed rollers, which are of somewhat larger diameter than the rigid rollers so as to form nips of appreciable extent in the direction of feed. Registration gates mounted for rotation on one of the roller shafts through slipping couplings are selectively restrained against rotation with the roller shaft either in a non-blocking position out of the feed path or in a blocking position within the nip area of the compliant rollers but upstream of the nip area of the rigid rollers.

In another aspect, our invention contemplates a sheet crimper comprising an anvil rotating with one of the registration gates and a hammer supported by the anvil for movement into a recess in the anvil. The crimper deforms a leading edge portion of the carrier sheet as the sheet is advanced from the registration rollers to facilitate separation of the sheet from the photoconductor after image transfer by a pickoff element spaced from the photoconductor.

BRIEF DESCRIPTION OF THE DRAWINGS

In the accompanying drawings, which form part of the instant specification and which are to be read in conjunction therewith, and in which like reference numerals are used to indicate like parts in the various views:

FIG. 7 is an enlarged fragmentary section of the sheet crimper of the registration assembly shown in FIG. 6, taken along line 7—7 thereof.

FIG. 8 is a greatly enlarged fragmentary view of the pickoff area of, the copier shown in FIG. 1.

FIG. 9 is a greatly enlarged fragmentary section of the pickoff area of the copier shown in FIG. 1 along line 9—9 thereof.

FIG. 10 is a greatly enlarged fragmentary section of the pickoff area of the copier shown in FIG. 1 along line 10—10 of FIG. 8.

FIG. 11 is a schematic diagram of the control circuit for the sheet-feeding and registration portions of the copier shown in FIG. 1.

DESCRIPTION OF THE PREFERRED EMBODIMENT

Figure 1:
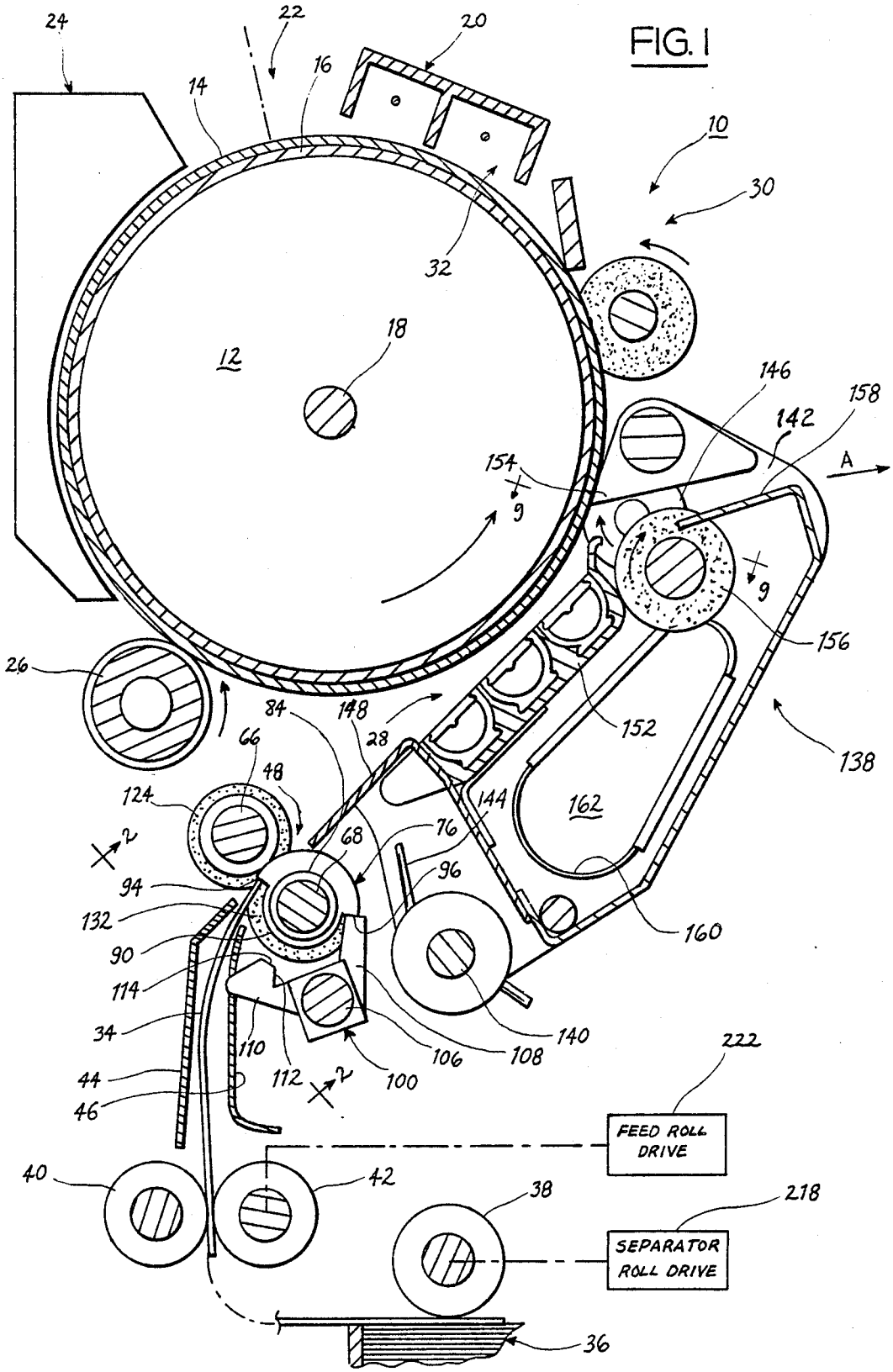
FIG. 1 is a fragmentary section of the processing and sheet-feeding portions of an electrophotographic copier incorporating our registration assembly.

Referring now to FIG. 1, a copier, indicated generally by the reference numeral 10, incorporating our registration assembly includes an electrophotographic imaging drum, indicated generally by the reference numeral 12, having a peripheral photoconductor 14 supported by a conductive substrate 16. Drum 12 is mounted on a shaft 18 for rotation therewith, and is driven in the counterclockwise direction as viewed in FIG. 1 at a uniform velocity by any suitable means (not shown). In a manner well known in the art, the drum photoconductor 14 is rotated first past a charging station 20 at which the surface of the photoconductor receives a uniform electrostatic charge, then past an exposure station 22 at which the electrostatically charged surface is exposed to a flowing light image of an original document (not shown) to form an electrostatic latent image, then past a developing station 24 at which a carrier liquid containing a suspension of charged toner particles is applied to the latent-image-bearing surface to form a developed toner image. Upon emerging from the developing station 24, the developed-image-bearing surface 14 moves past a metering roller 26, which is disposed at a slight spacing from the surface 14 and rotated in a reverse direction of surface movement at a high speed to reduce the thickness of the liquid layer (not shown) on the surface 14. Thereafter, the surface 14 moves past a transfer station 28 at which the developed toner image is transferred from the photoconductor to a carrier sheet 34, past a cleaning station 30 at which the surface 14 is cleaned of any remaining toner particles or developer liquid, and finally past an erasing corona 32 which neutralizes any remaining electrostatic charge on the surface 14.

In the sheet-feeding portion of copier 10, a friction separator roller 38 bearing against the upper sheet of a stack 36 of carrier sheets is momentarily driven at the proper time in the copy cycle, in a manner to be described, to advance the top sheet 34 to the left as viewed in FIG. 1 to a pair of opposing feed rollers 40 and 42. Rollers 40 and 42 continue to feed the sheet 34 upwardly between a pair of spaced guides 44 and 46 to a registration assembly, indicated generally by the reference numeral 48, that is the subject matter of our invention.

Figure 2:
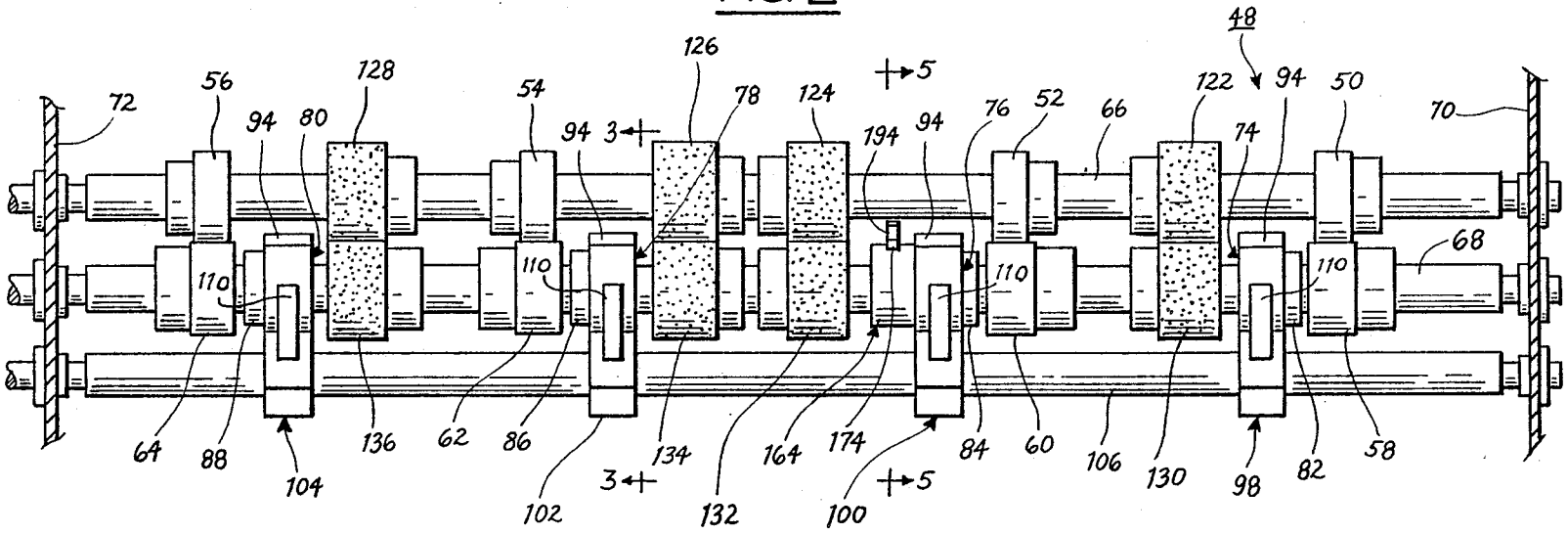
FIG. 2 is a fragmentary section of the registration assembly of the copier shown in FIG. 1, along line 2—2 thereof.

Referring now also to FIG. 2, in the registration assembly 48, an upper shaft 66 rotatably supported by respective front and rear side plates 70 and 72 of the copier 10 supports a plurality of axially spaced friction feed rollers 50, 52, 54 and 56, formed of a solid, or noncellular, elastomer such as polyurethane. Feed rollers 50 to 56 oppose a corresponding plurality of axially spaced lower feed rollers 58, 60, 62 and 64, preferably formed of the same noncellular elastomer material as upper rollers 50 to 56, supported on a lower shaft 68 rotatably received by the same side plates 70 and 72. Shafts 66 and 68 are driven continuously by any suitable means (not shown) at such a speed that rollers 50 to 64 move at the peripheral velocity of the drum 12.

Figure 3:
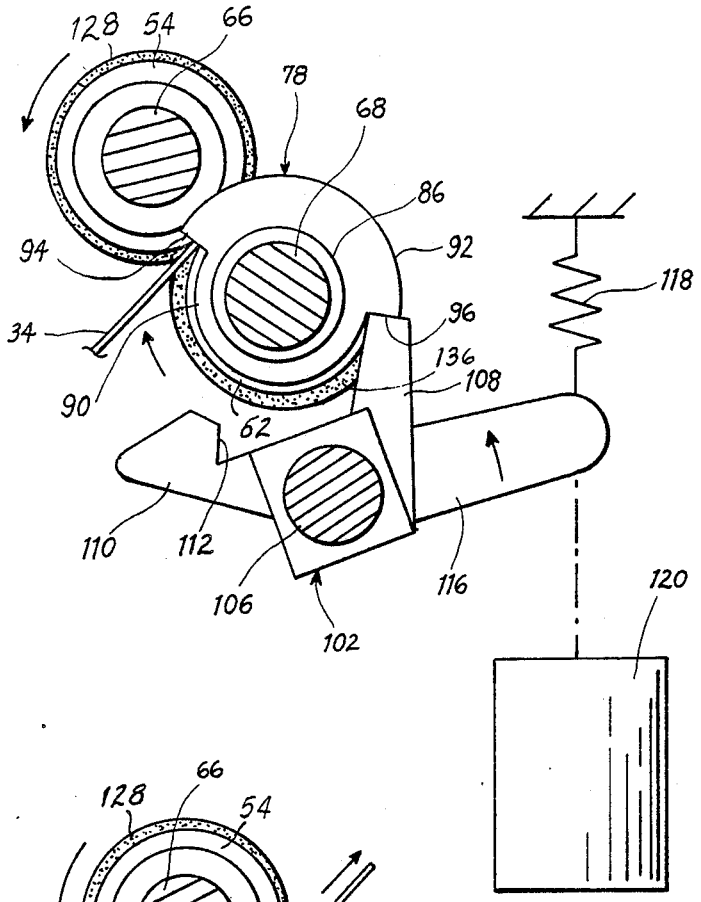
FIG. 3 is an enlarged section of the registration assembly shown in FIG. 2, taken along line 3—3 thereof with the registration gates held in a blocking position.
Figure 4:
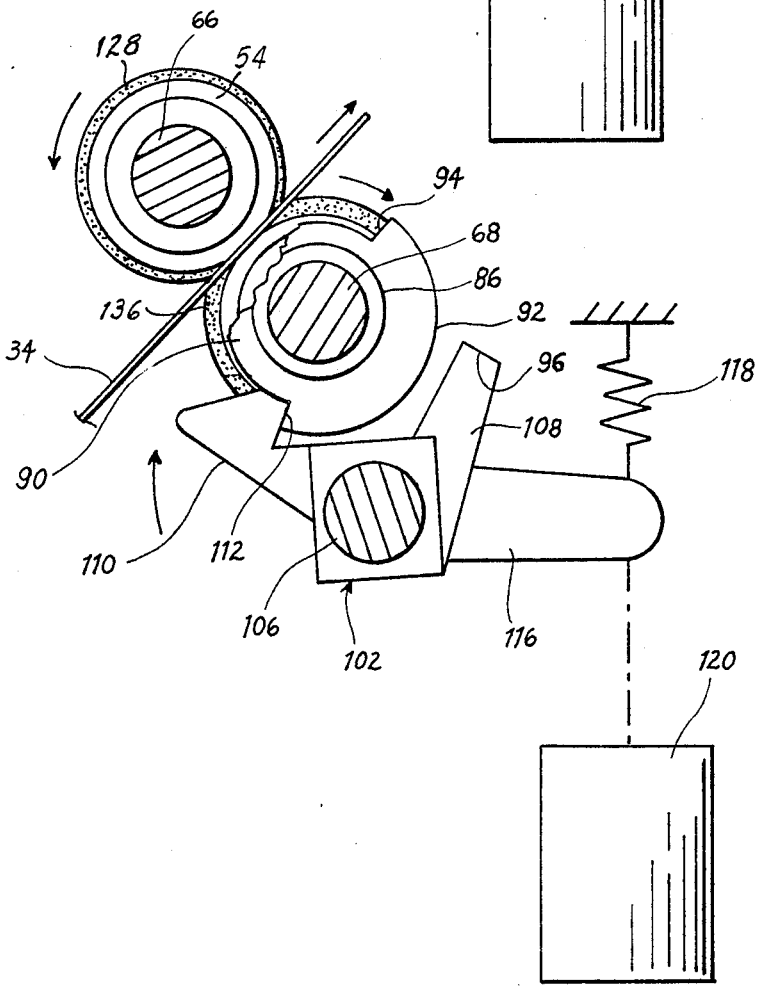
FIG. 4 is an enlarged section of the registration assembly shown in FIG. 2, taken along line 3—3 thereof, with the registration gates held in a non-blocking position.

Referring now also to FIGS. 3 and 4, we arrange respective rotary registration gates 74, 76, 78 and 80 on lower shaft 68 at locations just inboard of respective rollers 58 to 64. Respective clutches 82, 84, 86 and 88 of any suitable type known to the art provide slipping couplings between gates 74 to 80 and shaft 68. As shown in FIGS. 3 and 4 for gate 78, each of the gates 74 to 80 has a sector 90, smaller in diameter than solid rollers 58 to 64, as well as a sector 92 of appreciably larger diameter than rollers 58 to 64. Larger-diameter sector 92 has a radially extending trailing edge 94 that serves as a registration edge for copy sheets 34 approaching the nip formed by rollers 50 to 64.

The leading edges 96 of gate sectors 92 serve a stops for controlling the positions of the gates 74 to 80. Referring also to FIG. 2, respective control latches 98, 100, 102 and 104, supported by a shaft 106 rotatably received by side plates 70 and 72, are selectively actuated to arrest gates 74 to 80 either in a blocking position, shown in FIG. 3, in which registration edges 94 are about 2 to millimeters upstream of the nips formed by rollers 50 to 64, or in a nonblocking position, shown in FIG. 4, in which sectors 92 are held at a position remote from the sheet path. Referring now particularly to FIGS. 3 and 4, each of the latches 98 to 104 has an upwardly extending arm 108, as well as a lower arm 110 formed with a catch 112. A tension spring 118 extending between the copier frame and an arm 116 carried by shaft 106 normally biases shaft 106, and hence latches 98 to 104, counterclockwise to the position shown in FIG. 3, in which the upper arms 108 arrest registration gates 74 to 80, causing them to slip relative to shaft 68, in the blocking position shown in FIG. 3. In this position, gates 74 to 80 hold the leading edge of sheet 34 in a registered position about 2 to 3 millimeters upstream from the nip of solid rollers 50 to 64.

When it is desired to feed sheet 34 through the nip, a solenoid 120 is actuated to rotate the latches 98 to 104 clockwise, against the action of the spring 118. This retracts the upper arms 108 from gates 74 to 80, allowing the gates to rotate with shaft 68. Gates 74 to 80 continue to rotate until gate sectors 92 reach catches 112, which bear against gates 74 to 80 under the action of solenoid 120. At this point, gates 74 to 80 again slip relative to shaft 68 in the non-blocking position shown in FIG. 4, with the gate sectors 92 remote from the sheet path. After the trailing edge of a sheet 34 has cleared the registration assembly 48, solenoid 120 is again deactuated to allow gates 74 to 80 to rotate along with shaft 68 until they reach the registration position shown in FIG. 3, in preparation for the next copy sheet 34.

To ensure against momentary slippage of sheet 34 relative to solid rollers 50 to 64 as the sheet is fed forward from the roller nip, we also provide upper shaft 66 with axially spaced foam feed rollers 122, 124, 126 and 128 inboard of respective registration gates 74 to 80. Likewise, we provide lower shaft 68 with respective foam feed rollers 130, 132, 134 and 136 at locations opposite upper foam rollers 122 to 128. Rollers 122 to 136, which are formed of any suitable elastomeric cellular material such as polyurethane, are of appreciably larger diameter than solid rollers 50 to 64. Accordingly, in the blocking position shown in FIG. 3, the registration edges 94, while lying upstream of the nips of solid rollers 50 to 64, lie within the nip region of foam rollers 122 to 136. Thus, rollers 122 to 136, which rotate continuously, grip a sheet 34 with sufficient force to ensure that the sheet is fed forward without slipping when the sheet is advanced from the registration assembly 48 to the transfer station 28. At the same time, rollers 122 to 136 do not press against sheet 34 with sufficient force to crumple the leading edge of the sheet against registration edges 94.

Figure 6:
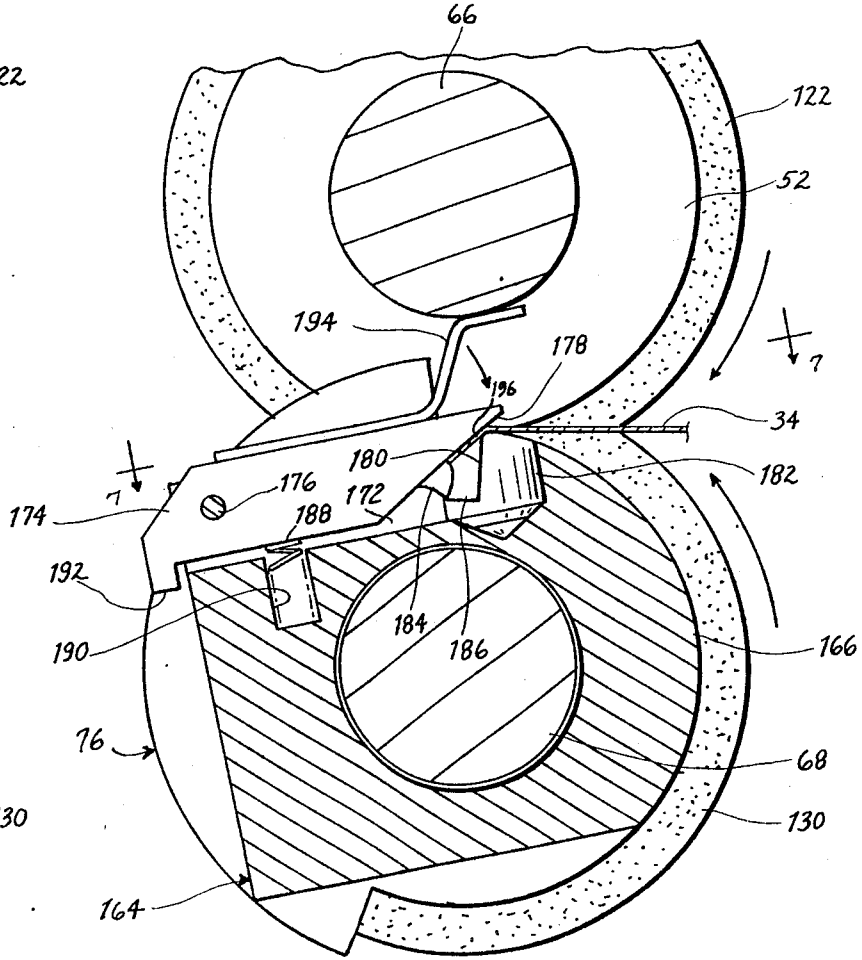
FIG. 6 is an enlarged section of the sheet crimper of the registration assembly shown in FIG. 2, at a stage in the copy cycle subsequent to that in which a sheet is blocked.
Figure 5:
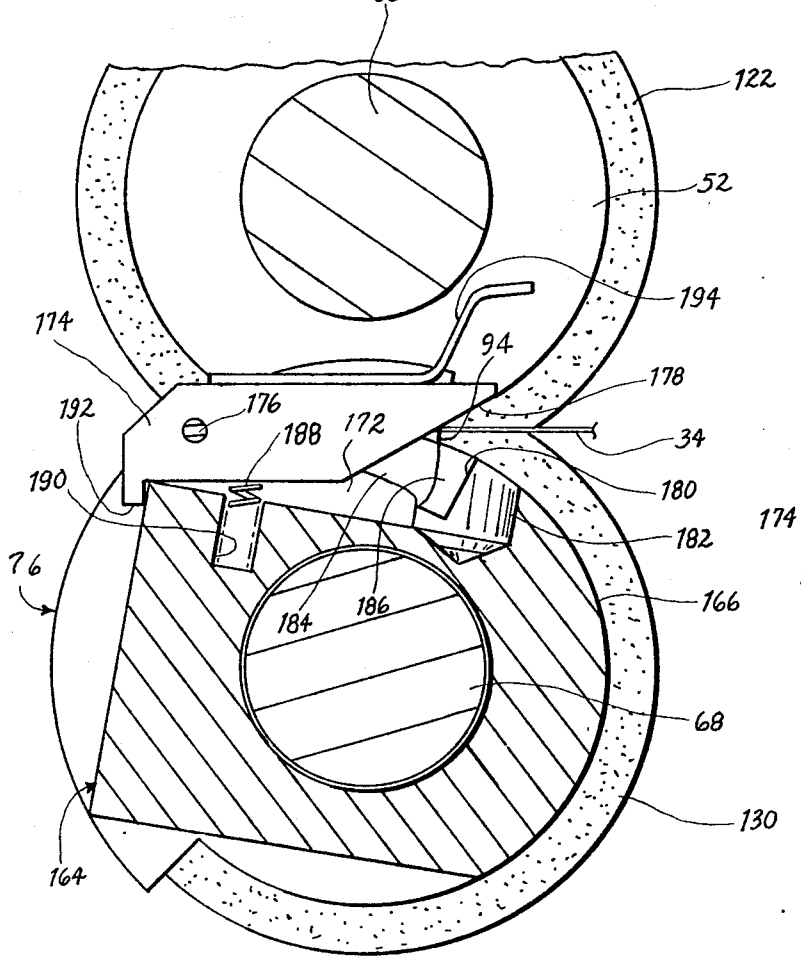
FIG. 5 is an enlarged section of the sheet crimper of the registration assembly shown in FIG. 2, taken along line 5—5 of FIG. 2, with the registration gates in the blocking position shown in FIG. 3.

Referring now particularly to FIGS. 5 to 7, the crimper of the registration assembly 48, indicated generally by the reference numeral 164, includes a rotary anvil 166 having a rounded sheet-receiving portion substantially the same diameter as solid rollers 58 to 64. A reduced-diameter sleeve 168 of anvil 166 forms an interference fit with a counterbore 170 formed in registration gate 76, so that crimper 164 rotates with gate 76 and is controlled in a like manner by solenoid 120. A pin 176 received by anvil 166 supports a hammer 174 for pivotal movement into a slot 172 formed in the anvil 166. Hammer 174 is formed at the end remote from pin 176 with an oblique clamping surface 178 movable against the corner portion 180 of a metal insert 182 received by anvil 166. A compression spring 188 received in a bore 190 formed in slot 172 urges hammer 174 partly out of the slot 172 to an open position defined by a limit stop 192 of hammer 174 which abuts anvil 166. Preferably, slot 172 is formed with chamfers 184 along its outer edges, while metal insert 182 is formed with a slot 186 of the same width as the chamfered portion of slot 172.

Crimper 164 is so arranged angularly relative to registration gate 76 that in the blocking position shown in FIG. 3, crimper 164 is in the position shown in FIG. 5, with the clamping surface 178 just above the registered leading edge of the sheet 34 and with the hammer 174 in its open position. As the crimper 164 rotates with gate 76 upon actuation of solenoid 120, a leaf spring 194 carried by hammer 174 bears against upper shaft 66 to urge hammer 174 into the recess 172. By the time crimper 164 reaches the position shown in FIG. 6, spring 194 has urged hammer 174 fully into the recess 172 to sandwich the leading edge portion of the sheet 34 between surface 178 and corner portion 180 to form a crimp 196 in the sheet 34. As the crimper 164 continues to rotate beyond the position shown in FIG. 6, leaf spring 194 clears upper shaft 66, allowing compression spring 188 to urge hammer 74 out of the recess 172, releasing the sheet portion 34. Crimper 164 thereafter continues to rotate along with gate 176 until the gate reaches the non-blocking position shown in FIG. 4, in which it is held by catch 112. With the crimper thus retracted from the sheet path, the sheet 34 continues to advance toward the transfer station 28, without interference either from the hammer 174 or from the registration gates 74 to 80. When the trailing edge of the sheet clears the registration assembly 48, solenoid 120 is again deactuated to return gates 74 to 80 to the position shown in FIG. 3, and hence crimper 164 to the position shown in FIG. 5, in preparation for the arrival of another sheet.

Referring again to FIG. 1, the transfer and pickoff assembly of the copier 10, indicated generally by the reference numeral 138, is located in the transfer station 28. Assembly 138 is supported by a transversely extending shaft 140 for pivotal movement relative to the side plates 70 and 72 of the copier 10. Torsion springs 144 bias the assembly 138 upwardly to a position defined by spacer rollers 146 carried by respective side plates 142 of the assembly 138 at locations opposite the edges of the drum surface 14. As a copy sheet 34 enters the transfer station 28 from the registration assembly 48, it moves first along a lower guide 148 of assembly 138. Lower guide 148 directs the sheet 34 past a transfer corona 152 which provides sheet 34 with an electrostatic charge opposite in polarity to that of the developed image on the drum 12, so as to attract the image electrostatically from the drum 12 to the paper 34.

Referring also to FIGS. 8 to 10, a pickoff blade 154, aligned axially with crimper hammer 174 and carried by assembly 138 at a location slightly downstream of transfer corona 152, engages the crimped portion 196 of the sheet 34 to initiate the separation of the sheet from the drum surface 14. Pickoff blade 154 directs the separated leading portion of the sheet 34 toward a set of axially spaced foam rollers 156, which rotate at the velocity of the drum surface 14 to direct the sheet along an exit guide 158 to an exit path A leading to an output tray (not shown). A vacuum source 162 coupled to the underside of rollers 156 and guide 158 by way of a port 160 at the rear of the transfer assembly 138 attracts the separated portion of the sheet 34 toward the rollers and guide so as to prevent smearing of the image by prolonged contact with the blade 154.

Rollers 146 space pickoff blade 154 a distance from the photoconductor surface 14 which is preferably greater than the thickness of the layer (not shown) of remaining toner material and carrier liquid on the surface, but less than the depth of the crimp 196 at the leading edge of the sheet 34. Further, the thickness of the pickoff blade 154 should be less than the width of the crimp 196. As a particular example, the pickoff blade 154 may be spaced 0.2 to 0.3 millimeter from the surface 14 and have a thickness of 0.5 millimeter, while the hammer 174 and slot 172 may be so formed as to produce a crimp 2 millimeters wide, 0.5 millimeter deep at the leading edge of the sheet 34, and 4 to 5 millimeters long.

Referring now to FIG. 11, the control circuit for the registration assembly 48, indicated generally by the reference numeral 200, includes a digital counter 202 receiving a clock input from a disk encoder 204 that produces a train of pulses synchronous with the rotation of the drum 12 in a manner known in the art. Counter 202 also receives a reset input from a switch 206 that is momentarily closed at a predetermined point in the copy cycle, also in a manner known in the art. Switch 206 may be closed either in response to the rotation of the drum 12 to a predetermined angular position or in response to movement of a document scanning element (not shown) past a predetermined point.

Initially, registration gates 74 to 80 and crimper 164 are in the positions shown in FIGS. 3 and 5, and feed rollers 40 and 42 rotated by a drive 222. At a predetermined point in the copy cycle, a decoder 208 responsive to counter 202 supplies a timing pulse tl to the set (S) input of an RS flip-flop 216 to set the flip-flop. Flip-flop 216 actuates a separator roller drive 218 to initiate the feeding of a sheet 34 from stack 36. Feed rollers 40 and 42 continue to direct the sheet 34 toward the registration assembly 48.

As the leading edge of the sheet 34 approaches the registration assembly 48, an optical sensor 198 disposed on the feed path immediately downstream of the assembly supplies a signal to a delay circuit 210. Upon the lapse of a sufficient time period to permit the leading edge of the sheet 34 to enter the nips of foam rollers 122 to 136 and abut registration gates 74 to 80, the delay circuit 210 supplies a signal to the reset (R) input of flip-flop 216, disabling the separator roller drive 218. Delay circuit 210 also supplies a signal at that time to the R input of an RS flip-flop 220 controlling the feed roller drive 222 to disable the latter drive.

At a predetermined later point in the copy cycle, decoder 208 produces a pulse t2, which is supplied to the S inputs of flip-flop 220 and of another RS flip-flop 224 controlling the gate solenoid 120. As a result, gate solenoid 120 is actuated to permit registration gates 74 to 80 to rotate along with shaft 68 to a position clear of the sheet path, allowing rollers 50 to 64 to advance the sheet 64 to the transfer station 28. In the course of movement of gate 76 and crimper 164 from the position shown in FIG. 5, hammer 174 clamps a leading edge portion of sheet 34 against corner 180 to form a crimp 196, as shown in FIG. 6. Simultaneously with the actuation of solenoid 120, feed roller drive 222 is actuated to drive the feed rollers 40 and 42. Feed roller drive and gate solenoid 120 remain actuated until the trailing edge of the sheet 34 clears the gate sensor 198, at which time an inverter 212 supplies a high-level logic signal to a delay circuit 214. Upon the lapse of a predetermined period of time sufficient, to permit the trailing edge of the sheet to clear the registration assembly 48, delay circuit 214 supplies a high-level logic signal to the R input of flip-flop 224, disabling gate solenoid 120. As a result, registration gates 74 to 80 are again allowed to rotate until they reach the blocking position shown in FIG. 3, in preparation for another cycle similar to the one just described.

It will be seen that we have accomplished the objects of our invention. Our registration system ensures accurate registration of a sheet prior to its feeding to a subsequent location, such as the transfer station of an electrophotographic copier. Our registration system advances a sheet to a subsequent station without slipping or skewing, and allows the use of a pickoff member that is spaced from the photoconductor. Moreover, our registration system permits the use of such a spaced separator member without producing large image voids along the leading edge of the sheet. Finally, our registration system is simple and inexpensive.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for registering a sheet at a predetermined location along a path comprising a relatively rigid feed member disposed along the path, a relatively compliant feed member disposed along the path at a position axially aligned with said rigid feed member, first means cooperating with said relatively rigid feed member to form a first nip, second means cooperating with said relatively compliant feed member to form a second nip having a longitudinal extent greater than said first nip, means independent of said feed members for registering the sheet, said registering means including a registration member axially aligned with said rigid feed member and said compliant feed member and mounted for movement into a first position which corresponds to the position of the second nip but which does not correspond to the position of said first nip so as to block the path for registering the sheet with an edge portion thereof extending within said second nip but outside said first nip and into a second position remote from the path for allowing movement of the sheet after registration, means for continuously driving said feed members, said relatively compliant feed member pressing the edge portion of the sheet within said second nip against said registration member in said first position, and said relatively rigid feed member advancing the sheet through said first nip with said registration member in said second position.

2. Apparatus as in claim 1 further comprising a rotatable shaft supporting said feed members and said registration member, means for continuously rotating said shaft to rotate said feed members and said registration member, and said registration means including means providing a friction coupling between said registration member and said shaft and selectively operable means for intercepting said registration member at said first and second positions.

3. Apparatus as in claim 2, wherein said selectively operable means comprises a control member having first and second catches and means for mounting said control member for movement between a first location at which said first catch intercepts said registration member in said first position and a second location at which said second catch intercepts said registration member in said second position.

4. Apparatus as in claim 2 further comprising first and second rotatable shafts, first means for continuously driving said first shaft, second means for continuously driving said second shaft, a first relatively rigid feed member mounted on said first shaft for rotation therewith, said first cooperating means comprising a second relatively rigid feed member mounted on said second shaft for rotation therewith, said second relatively rigid feed member opposing said first relatively rigid feed member, a first relatively compliant feed member mounted on said first shaft for rotation therewith, a second relatively compliant feed member mounted on said second shaft for rotation therewith, said second relatively compliant feed member opposing said firs relatively compliant feed member.

5. Apparatus for registering a sheet at a predetermined location along a path comprising first and second rotatable shafts, first means for continuously driving said first shaft, second means for continuously driving said second shaft, a first relatively rigid feed member mounted on said first shaft for rotation therewith, a second relatively rigid feed member mounted on said second shaft for rotation therewith, said second relatively rigid feed member opposing said first relatively rigid feed member to form a first nip, a first relatively compliant feed member mounted on said first shaft for rotation therewith, a second relatively compliant feed member mounted on said second shaft for rotation therewith, said second relatively compliant feed member opposing said first relatively compliant feed member to form a second nip having a longitudinal extent greater than said first nip, said feed members being disposed along the path with said relatively rigid feed members axially aligned with said relatively compliant feed members, a registration member mounted on said first shaft, means providing a friction coupling between said registration member and said first shaft, said registration member being rotatable into a first position which corresponds to the position of said second nip but which does not correspond to the position of said first nip so as to interrupt movement of the sheet along the path for registering the sheet with an edge portion thereof extending within said second ip but outside said first nip and rotatable into a second position remote from the path for allowing movement of the sheet after registration, and selectively operable means for coupling between said registration member at said first and second positions.

6. Apparatus as in claim 5, wherein said selectively operable means comprises a control member having first and second catches and means for mounting said control member for movement between a first location at which said first catch intercepts said registration member in said first position and a second location at which said second catch intercepts said registration member in said second position.

* * * * *